US009705226B1

(12) United States Patent
Lyon

(10) Patent No.: US 9,705,226 B1
(45) Date of Patent: Jul. 11, 2017

(54) CENTER LOAD TERMINAL POSITION ASSURANCE FOR AN ELECTRICAL CONNECTOR

(71) Applicant: TYCO ELECTRONICS CORPORATION, Berwyn, PA (US)

(72) Inventor: Zachary Wood Lyon, Lewisville, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/181,941

(22) Filed: Jun. 14, 2016

(51) Int. Cl.
*H01R 13/426* (2006.01)
*H01R 13/428* (2006.01)

(52) U.S. Cl.
CPC ..... *H01R 13/426* (2013.01); *H01R 13/428* (2013.01)

(58) Field of Classification Search
CPC ..... H01R 13/426; H01R 13/428
See application file for complete search history.

(56) References Cited

U.S. PATENT DOCUMENTS

| | | | | |
|---|---|---|---|---|
| 7,048,581 | B1 * | 5/2006 | Wong | H01R 13/426 439/595 |
| 9,356,378 | B1 * | 5/2016 | Glick | H01R 43/20 |
| 2015/0011127 | A1 * | 1/2015 | Ngo | H01R 12/724 439/626 |
| 2015/0087190 | A1 * | 3/2015 | Schwan | H01R 13/4362 439/695 |
| 2017/0077636 | A1 * | 3/2017 | Nagasawa | H01R 13/426 |

* cited by examiner

*Primary Examiner* — James Harvey

(57) ABSTRACT

An electrical connector includes a housing having a plurality of terminal towers with terminal channels therein. The terminal towers surround a central cavity. A TPA device is front loaded into the central cavity through a mating end in a loading direction. The TPA device includes a locking device having locking tabs. The locking device is loaded into the central cavity in the loading direction to a loaded position and moved in a locking direction generally perpendicular to the loading direction to a locked position. The locking tabs are at least partially received in the terminal channels in corresponding terminal towers in blocking positions for blocking removal of the terminals from the terminal channels when in the locked position.

20 Claims, 7 Drawing Sheets

CENTER LOAD TERMINAL POSITION ASSURANCE FOR AN ELECTRICAL CONNECTOR

BACKGROUND OF THE INVENTION

The subject matter herein relates generally to terminal position assurance components for electrical connectors.

It is known in various industries to have electrical connectors in the form of plugs and headers to provide electrical connection in such systems as automotive systems, for example, for engine electronics, engine control management systems and the like. At least some known electrical connectors provide terminal position assurance (TPA) devices which assure that the electrical terminal or contact is fully positioned before installing the fully loaded connector assembly into its end application. Such assemblies having TPA devices find substantial utility in automotive use as a terminal or contact which is not fully loaded in the connector, can cause an open circuit in an automotive harness. This in turn can cause substantial cost and effort to isolate and fix the problem.

Known TPA devices are normally insertable into the electrical connector housing from the side to a position where it lies adjacent to a terminal latching device and which can only be fully inserted if the terminal itself is fully inserted, and when the terminal latch within the housing is in its terminal locked position. The side loaded TPA devices create potentially problematic open areas in the housing because of the side access. The open areas inherently create tooling flash, allow for water ingress, dust/dirt ingress and other problematic environmental influences on the functionality and reliability of the product.

BRIEF DESCRIPTION OF THE INVENTION

In one embodiment, an electrical connector is provided including a housing having a mating end at a front of the housing and a base at a rear of the housing. The housing has a plurality of terminal towers extending forward of the base toward the mating end. Each terminal tower has a terminal channel therein configured to receive a corresponding terminal therein. The terminal towers surround a central cavity between the plurality of terminal towers. A terminal position assurance (TPA) device is received in the central cavity. The TPA device is front loaded into the central cavity through the mating end in a loading direction toward the base. The TPA device includes a locking device having a plurality of sides. The locking device has locking tabs extending from at least two of the sides. The locking device is loaded into the central cavity in the loading direction to a loaded position. The locking device is moved in a locking direction generally perpendicular to the loading direction from the loaded position to a locked position. The locking tabs allow movement of the terminals into and out of the terminal channels when in the loaded position. The locking tabs are at least partially received in the terminal channels in corresponding terminal towers in blocking positions for blocking removal of the terminals from the terminal channels when in the locked position.

In another embodiment, an electrical connector is provided including a housing having a mating end at a front of the housing and a base at a rear of the housing. The housing has a plurality of terminal towers extending forward of the base toward the mating end. Each terminal tower has a terminal channel therein configured to receive a corresponding terminal therein. The terminal towers surround a central cavity between the plurality of terminal towers. The terminal towers have interior sides facing the central cavity. The internal sides having locking slots open to the terminal channels. A terminal position assurance (TPA) device is received in the central cavity. The TPA device is front loaded into the central cavity through the mating end in a loading direction toward the base. The TPA device includes a locking device having a plurality of sides. The locking device has locking tabs extending from at least two of the sides. The locking device is loaded into the central cavity in the loading direction to a loaded position. The locking tabs are aligned with the locking slots in the loaded position. The locking device is moved in a locking direction generally perpendicular to the loading direction from the loaded position to a locked position. The locking tabs are positioned in the locking slots when in the locked position for blocking removal of the terminals from the terminal channels.

In a further embodiment, an electrical connector is provided including a housing having a base at a rear of the housing and a shroud extending forward from the base to a mating end at a front of the housing. The shroud encloses a chamber forward of the base. The housing has a plurality of terminal towers extending forward of the base into the chamber. Each terminal tower has a terminal channel therein configured to receive a corresponding terminal therein. The terminal towers are spaced apart from each other and surrounded by gaps. The gaps define a central cavity between the plurality of terminal towers. The gaps define at least one perimeter cavity between the shroud and corresponding terminal towers. A terminal position assurance (TPA) device is received in the central cavity. The TPA device is front loaded into the central cavity through the mating end in a loading direction toward the base. The TPA device includes an outer frame received in the at least one perimeter cavity between the shroud and the corresponding terminal towers. The TPA device includes a central plate attached to the outer frame and positioned in the central cavity. The central plate has a mount extending therefrom. The TPA device includes a locking device slidably coupled to the mount. The locking device has a plurality of sides. The locking device has locking tabs extending from at least two of the sides. The locking device is moved in a locking direction generally perpendicular to the loading direction to a locked position. The locking tabs are at least partially received in the terminal channels in corresponding terminal towers in blocking positions for blocking removal of the terminals from the terminal channels when in the locked position.

DETAILED DESCRIPTION OF THE INVENTION

Figure 1:
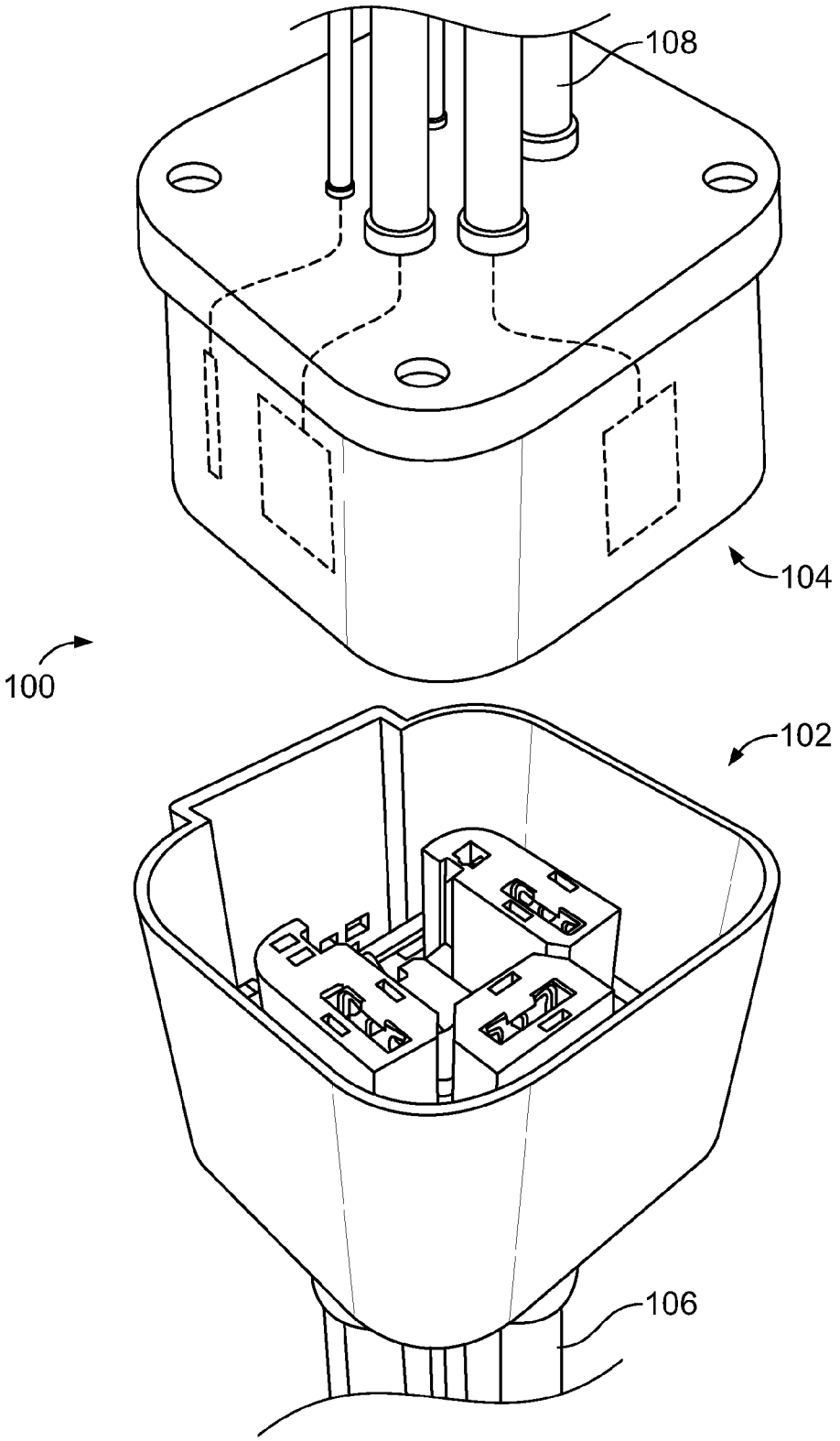
FIG. 1 is a perspective view of a connector assembly formed in accordance with an exemplary embodiment.

FIG. 1 is a perspective view of a connector assembly 100 formed in accordance with an exemplary embodiment. The connector assembly 100 is configured to be panel mounted to a panel, such as a chassis, bulk head, casing, and the like of a vehicle, machine or structure. The connector assembly 100 is durable and capable of use in rugged or extreme environments. The connector assembly 100 may be used to transmit data and/or power within the vehicle, machine or structure. The connector assembly 100 may be sealed.

The connector assembly 100 includes an electrical connector 102 and a mating connector 104. In an exemplary embodiment, the mating connector 104 is a header connector configured to be mounted to the panel and the electrical connector 102 is a plug connector configured to be mated with the header connector. Optionally, portions of the electrical connector 102 are plugged into the mating connector 104. Optionally, portions of the mating connector 104 are plugged into the electrical connector 102. In an exemplary embodiment, the electrical connector 102 is terminated to one or more cables or wires 106. The mating connector 104 is terminated to one or more cables or wires 108. The wires 106, 108 may be power wires, signal wires, or other types of wires.

Embodiments of the electrical connector 102 described herein provide a terminal positional assurance (TPA) device used to assure that the terminals of the electrical connector 102 are properly positioned and held in the electrical connector 102. Embodiments of the TPA device described herein may provide centralized secondary locking to a plurality of different terminals. Embodiments of the TPA device described herein allow center loading of the TPA device into the housing of the electrical connector 102 through the front or mating end of the housing. Embodiments of the electrical connector 102 eliminate side loading of the TPA device, which may eliminate openings through the side of the housing of the electrical connector 102, which may in turn reduce tooling flash, water or debris ingress, and may reduce the overall size of the electrical connector 102. Embodiments of the electrical connector 102 described herein provide a sealed interface between the electrical connector 102 and the mating connector 104.

Figure 2:
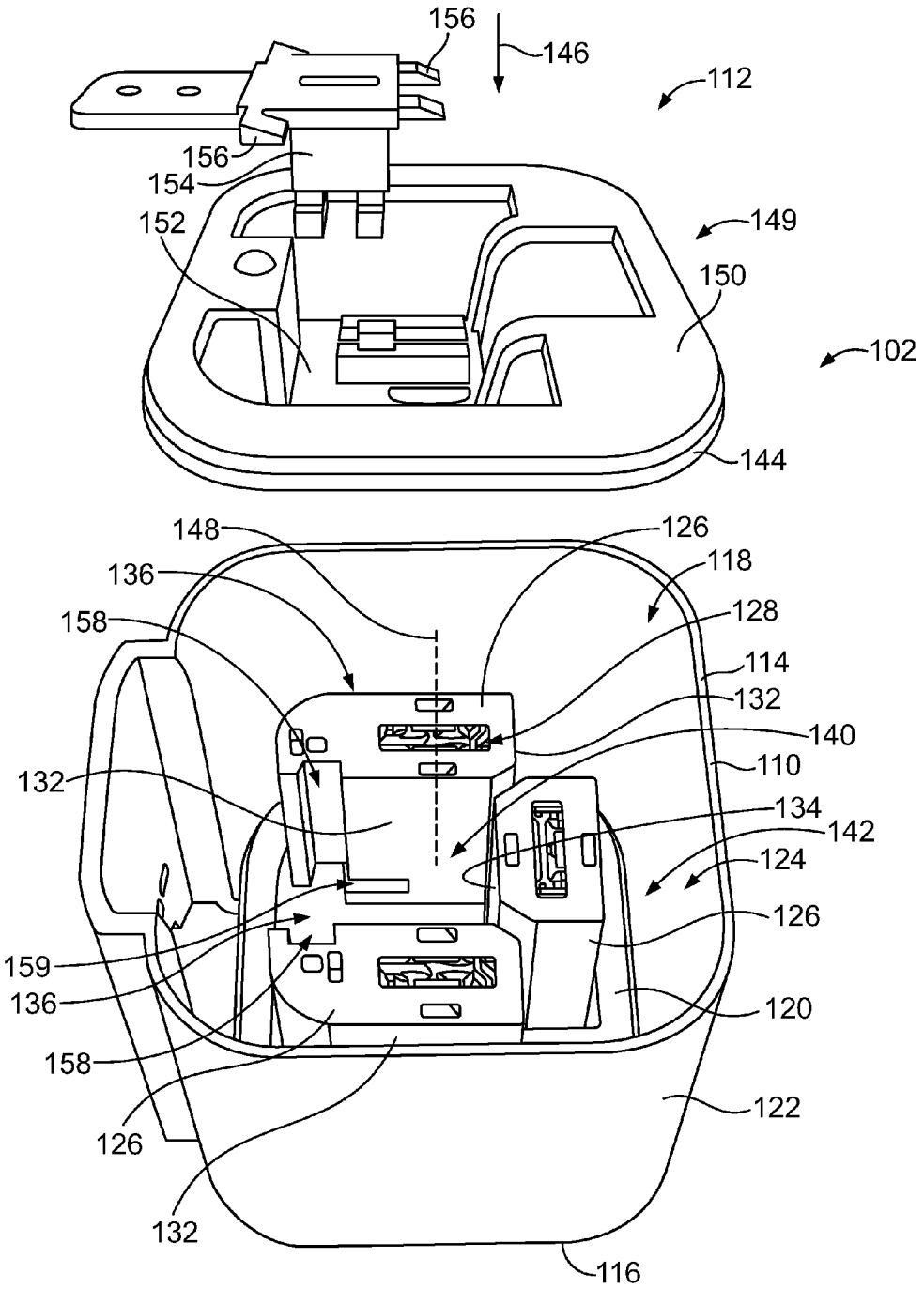
FIG. 2 is an exploded view of an electrical connector of the connector assembly in accordance with an exemplary embodiment.

FIG. 2 is an exploded view of the electrical connector 102 formed in accordance with an exemplary embodiment. The electrical connector 102 includes a housing 110 and a TPA device 112. The housing 110 extends between a front 114 and a rear 116. The front 114 defines a mating end 118 configured to be mated with the mating connector 104 (shown in FIG. 1). The housing 110 includes a base 120 at the rear 116 and a shroud 122 extending forward of the base 120 to the front 114. The shroud 122 defines a chamber 124 forward of the base 120.

The housing 110 includes a plurality of terminal towers 126 extending forward from the base 120 within the chamber 124. The terminal towers 126 each include at least one terminal channel 128 extending therethrough. The terminal channels 128 receive corresponding terminals 130 (shown in FIG. 3), which are configured to be electrically connected to corresponding terminals of the mating connector 104. The terminals 130 are electrically connected to corresponding wires 106. The terminal channels 128 are open at front ends of the terminal towers 126 to receive correspond mating terminals of the mating connector 104. For example, the mating terminals of the mating connector 104 may be pins or blades loaded into the terminal channels 128 for electrical connection with the terminals 130.

The terminal towers 126 include exterior surfaces 132. The exterior surfaces 132 define sides 134 of the terminal towers 126. In the illustrated embodiment, the terminal towers 126 have a generally rectangular or oval cross-sectional shape, however the terminal towers 126 may have other shapes in alternative embodiments, such as cylindrical shapes, oblong shapes, or other shapes. The terminal towers 126 may include any numbers of sides 134. Transitions between the sides 134 may be angular or curved.

In an exemplary embodiment, the exterior surfaces 132 are surrounded by gaps. For example, the gaps 136 may be provided between the terminal towers 126. The gaps 136 may be provided between the terminal towers 126 and the shroud 122. In an exemplary embodiment, the gaps 136 define a central cavity 140 generally centrally located within the chamber 124, such as between the various terminal towers 126. Optionally, each of the terminal towers 126 may be exposed to the central cavity 140. The gaps 136 may define a perimeter cavity 142 around a perimeter of the group of the terminal towers 126. For example, the perimeter cavity 142 may be defined between the shroud 122 and the exterior surfaces 132 of the group of terminal towers 126 that face the shroud 122. Optionally, the perimeter cavity 142 may extend entirely around the group of terminal towers 126 immediately interior of the shroud 122. Optionally, the chamber 124 may include other cavities in addition to the central cavity 140 and the perimeter cavity 142.

The TPA device 112 is configured to be loaded into the chamber 124. In an exemplary embodiment, a perimeter seal 144 is also loaded into the chamber 124. The perimeter seal 144 is configured to be positioned between the TPA device 112 and the housing 110. For example, the TPA device 112 is loaded into the chamber 124 to hold the perimeter seal 144 against the base 120 to seal the chamber 124. In an exemplary embodiment, the TPA device 112 is sized and shaped to fit in the chamber 124 adjacent the terminal towers 126. For example, a portion of the TPA device 112 may be received in the central cavity 140. A portion of the TPA device 112 may be received in the perimeter cavity 142. The outer perimeter of the TPA device 112 may have a complimentary shape to the interior surface of the shroud 122 such that the TPA device 112 substantially fills the bottom of chamber 124.

The TPA device 112 is configured to be front loaded into the chamber 124. For example, the TPA device 112 is loaded through the front 114 of the housing 110. The TPA device 112 is loaded in a loading direction 146 that is generally parallel to channel axes 148 of the terminal channels 128.

The loading direction 146 is also parallel to the mating direction of the electrical connector 102 with the mating connector 104. In an exemplary embodiment, the shroud 122 does not include any openings along the sides thereof to the chamber 124, but rather is only open at the front 114. As such, the shroud 122 may provide a robust sealed mating with the mating connector 104. The TPA device 112 includes an insert 149, including an outer frame 150 and a central plate 152, and a locking device 154 configured to be coupled to the insert 149. The insert 149 is configured to be inserted into the housing 110, such as through the front 114. The locking device 154 includes a plurality of locking tabs 156 used to lock the terminals 130 in the terminal towers 126. The TPA device 112 provides centralized securing of the terminals 130 in the terminal towers 126, such as by using a single locking device 154 to lock multiple terminals 130 in the corresponding terminal towers 126.

In an exemplary embodiment, the terminal towers 126 include loading slots 158 and locking slots 159. The loading slots 158 extend along the exterior surfaces 132 of the terminal towers 126, such as along the sides 134 facing the central cavity 140. The loading slots 158 are oriented generally parallel to the loading direction 146. As the locking device 154 of the TPA device 112 is loaded into the housing 110, the locking tabs 156 are received in and pass through the loading slots 158 as the locking device 154 is moved in the loading direction 146 to a loaded position, such as at or near the base 120. The locking slots 159 extend along the exterior surfaces 132 of the terminal towers 126, such as along the sides 134 facing the central cavity 140. The locking slots 159 are oriented generally perpendicular to the loading slots 158. The locking tabs 156 are received in and pass through the locking slots 159 as the locking device 154 is moved in a locking direction to a locked position. In the locked position, the locking tabs 156 block removal of the terminals 130 from the terminal channels 128.

Figure 3:
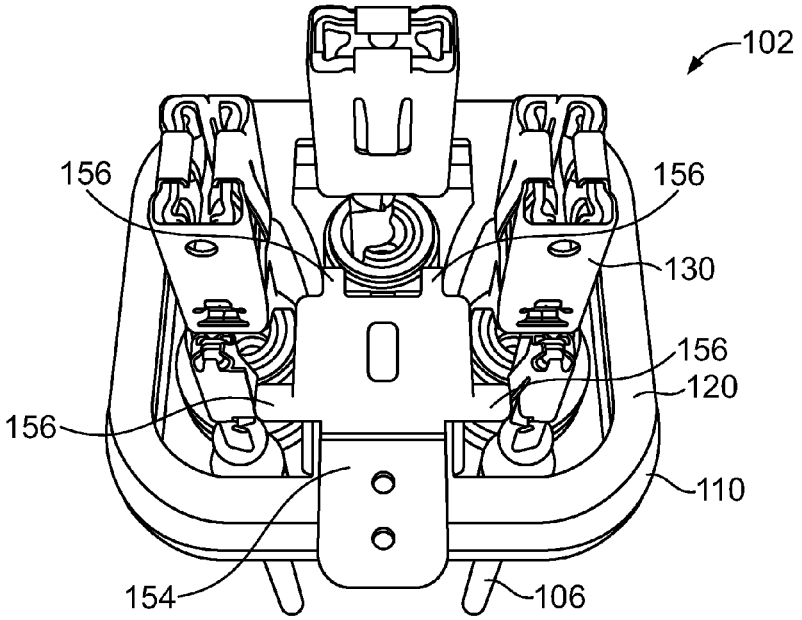
FIG. 3 is a perspective view of a portion of the electrical connector.

FIG. 3 is a perspective view of a portion of the electrical connector 102 with a portion of the housing 110 removed to illustrate the terminals 130. The base 120 is shown in FIG. 3, however the shroud 122 and the terminal towers 126 are removed to illustrate the terminals 130. The terminals 130 are terminated to corresponding wires 106. In the illustrated embodiment, the terminals 130 are sockets configured to receive pins or blades to make an electrical connection with the mating connector 104 (shown in FIG. 1). The terminals 130 and/or wires 106 may pass through the base 120. FIG. 3 illustrates the locking device 154 positioned relative to the terminals 130. The locking tabs 156 may be positioned behind corresponding features or surfaces of the terminals 130 to block rearward movement of the terminals 130. For example, the locking tabs 156 may be positioned immediately behind the rear ends of the sockets of the terminals 130 to block the terminals 130.

Figure 4:
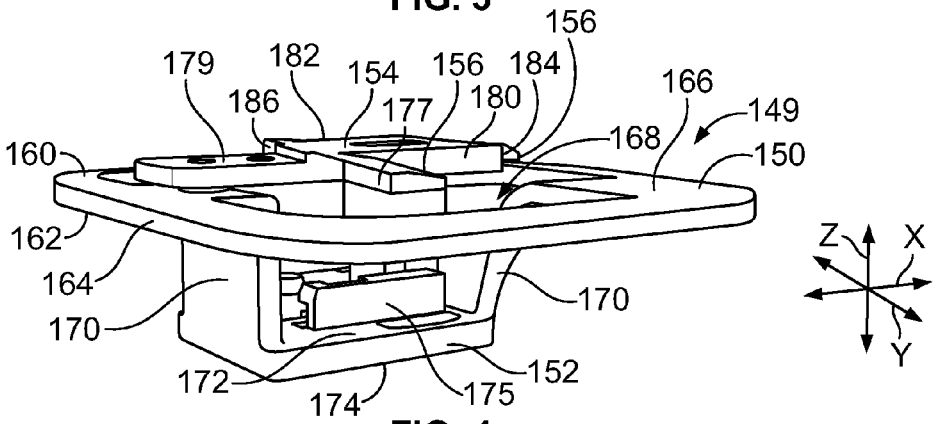
FIG. 4 is a top perspective view of a terminal position assurance (TPA) device of the electrical connector formed in accordance with an exemplary embodiment.
Figure 5:
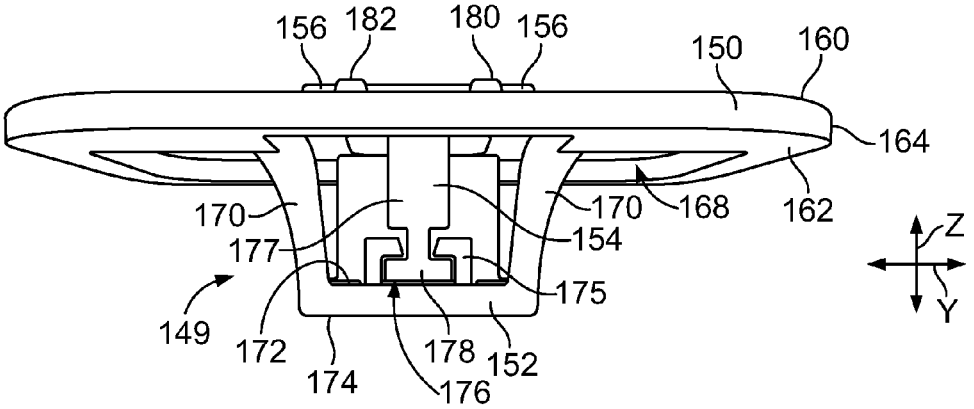
FIG. 5 is a bottom perspective view of the TPA device.

FIG. 4 is a top perspective view of the TPA device 112 formed in accordance with an exemplary embodiment. FIG. 5 is a bottom perspective view of the TPA device 112. FIGS. 4 and 5 illustrate the locking device 154 coupled to the insert 149. In an exemplary embodiment, the locking device 154 is a separate component from the insert 149. The outer frame 150 and the central plate 152 may be integral as a unitary one piece body to form the insert 149 and the locking device 154 may be a separate piece. The outer frame 150 and the central plate 152 may be molded as a single piece body and the locking device 154 may be molded as a single piece body.

The locking device 154 may be independently movable relative to the central plate 152 and the outer frame 150, such as to move between an unlocked position and a locked position for locking the terminals 130 (shown in FIG. 3) in the terminal towers 126 (shown in FIG. 2). Optionally, the locking device 154 may be coupled to the central plate 152 after the central plate 152 is coupled to the housing 110 (shown in FIG. 2). Alternatively, the locking device 154 may be coupled to the central plate 152 prior to loading the central plate 152 into the housing 110 such that the locking device 154 and the central plate 152 are loaded into the housing 110 as a unit and then the locking device 154 may later be moved relative to the central plate 152 from an unlocked position to a locked position, such as after the terminals 130 are loaded into the housing 110.

The outer frame 150 defines a perimeter of the TPA device 112. The outer frame 150 has a front 160 and a rear 162 (FIG. 6) opposite the front 160. The rear 162 may define a sealing surface for the perimeter seal 144 (shown in FIG. 2). In an exemplary embodiment, the outer frame 150 includes a rim or lip 164 extending around the perimeter of the outer frame 150. A shoulder 166 may be provided interior of the lip 164. The outer frame 150 includes a central opening 168 therethrough. The central opening 168 may be sized and shaped to receive the terminal towers 126. Optionally, the outer frame 150 may include multiple openings 168.

The central plate 152 is aligned with the central opening 168. The central plate 152 is connected to the outer frame 150 by one or more straps 170. In an exemplary embodiment, the central plate 152 is positioned rearward of the outer frame 150. For example, the straps 170 extend rearward to position the central plate 152 behind the outer frame 150. The central plate 152 is configured to be received in the central cavity 140 (shown in FIG. 2) of the housing 110, such as between the terminal towers 126. The central plate 152 includes a front 172 and a rear 174. The rear 174 may define the rearward most surface of the TPA device 112. The rear 174 may rest on the base 120 (shown in FIG. 2). Optionally, the central plate 152 may be generally planar, such as at the front 172 and/or the rear 174.

The central plate 152 includes a mount 175 at the front 172. The mount is used to secure the locking device 154 to the central plate 152. The mount 175 is configured to allow relative movement between the locking device 154 and the central plate 152. For example, the mount 175 may include a guide channel 176 that allows sliding movement of the locking device 154 relative to the central plate 152, such as in a locking/unlocking direction (e.g., in an x-direction). The guide channel 176 may limit movement in other directions (e.g., side-to-side in a y-direction and/or lifting off in a z-direction). As such, the guide channel 176 may limit movement of the locking device 154 along a linear movement path. However, other types of movement may be provided in alternative embodiments, such as in multiple directions and/or along a curved path. The mount 175 may include rails or tracks that define the guide channel 176. The mount 175 may include slots or openings that allow loading into or unloading from the guide channel 176 of the locking device 154.

The locking device 154 includes a main body 177 and a tail 178 extending rearward from the main body 177. The tail 178 is configured to be received in the mount 175. Optionally, multiple tails 178 may extend from the main body 177. The locking device 154 includes a securing plate 179 extending from the main body 177. The securing plate 179 may be used to secure the position of the locking device 154 relative to the outer frame 150 and/or the central plate 152. For example, the securing plate 179 may temporarily secure the locking device 154 in various different positions, such as an unlocked position and a locked position.

The locking tabs 156 extend from the main body 177. For example, the locking tabs 156 may extend from multiple sides of the main body 177. In the illustrated embodiment, one locking tab 156 is provided along a first side 180 of the main body 177, one locking tab 156 is provided along a second side 182 of the main body 177 opposite the first side 180 and a pair of locking tabs 156 are provided at a third side 184 of the main body 177, which extends between the first and second sides 180, 182. Other locking tabs 156 may be provided at other locations in alternative embodiments, including multiple locking tabs 156 along the first side 180 and/or along the second side 182. The securing plate 179 is provided at a fourth side 186 opposite the third side 184; however other locations are possible in alternative embodiments.

In an exemplary embodiment, the outer frame 150 includes a detent 188 (shown in FIGS. 7 and 8) extending from one of the shoulders 166. The detent 188 interacts with the securing plate 179 to hold the position of the locking device 154 relative to the outer frame 150, and thus relative to the central plate 152. For example, the under-side of the securing plate 179 may include dimples at various locations (such as at two locations) that receive the detent 188 and hold the position of the locking device 154. The holding force may be overcome to slide the locking device 154 in the locking direction, such as to lock or unlock the locking device 154 relative to the terminals 130.

Figure 6:
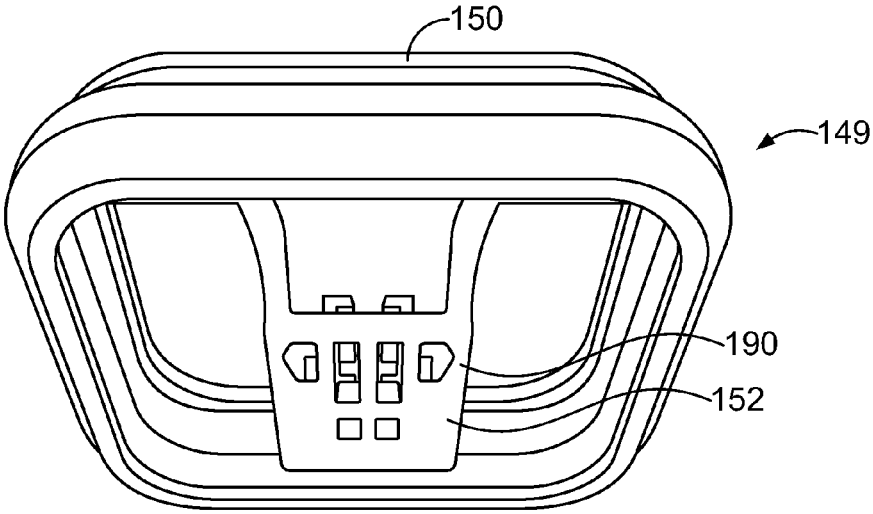
FIG. 6 is a bottom perspective view of an insert of the TPA device.
Figure 7:
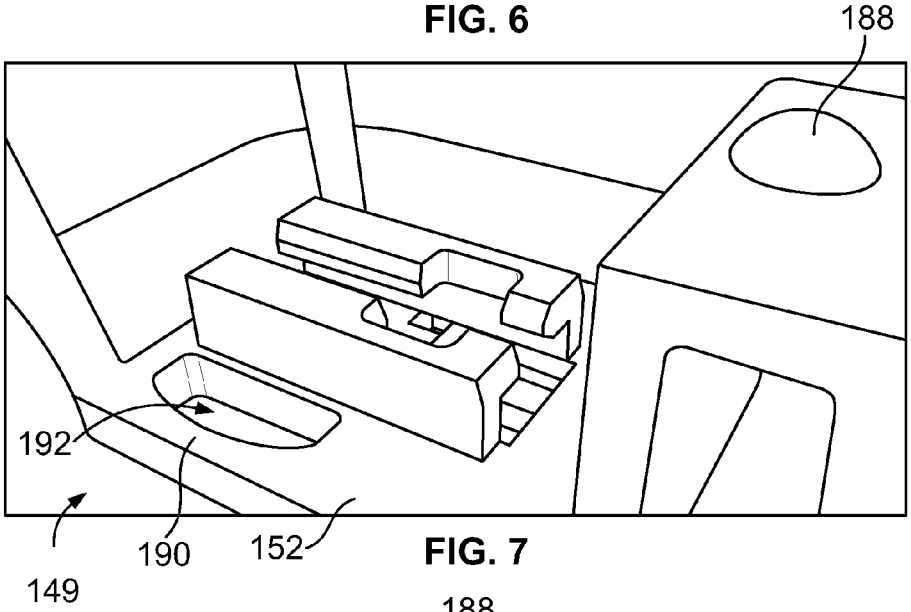
FIG. 7 is a top perspective view of a portion of the insert.
Figure 8:
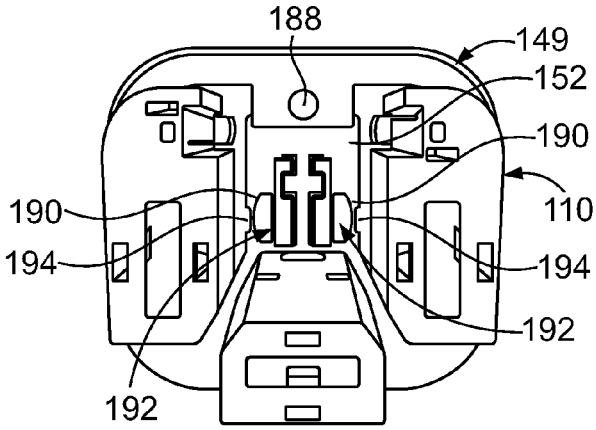
FIG. 8 is a top view of the insert loaded into a housing of the electrical connector.

FIG. 6 is a bottom perspective view of the insert 149, including the outer frame 150 and the central plate 152. FIG. 7 is a top perspective view of a portion of the insert 149. FIG. 8 is a top view of the insert 149 loaded into the housing 110 showing a portion of the housing 110. FIGS. 7 and 8 illustrate the detent 188.

The central plate 152 includes snap beams 190 used to secure the insert 149 in the housing 110. The snap beams 190 are positioned adjacent windows 192 through the central plate 152. The snap beams 190 are defined by a web of material between the windows 192 and the outer edges of the central plate 152. The snap beams 190 are deflectable and allow the central plate 152 to be secured in the housing 110 using latches 194 (FIG. 8). For example, the snap beams 190 may be deflected inward into the windows 192 by the latches 194 as the central plate 152 is pressed into the central cavity 140 past the latches 194. Once the snap beams 190 clear the latches 194, the snap beams 190 snap back into position and are captured below the latches 194.

Figure 9:
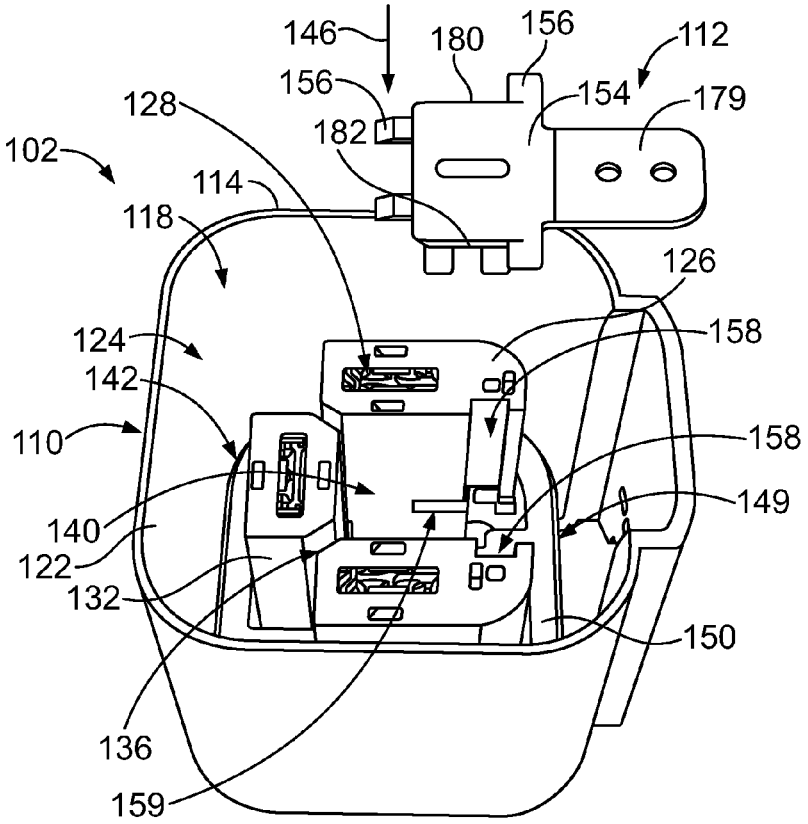
FIG. 9 is a perspective view of the electrical connector showing a locking device of the TPA device poised for loading into the housing.
Figure 10:
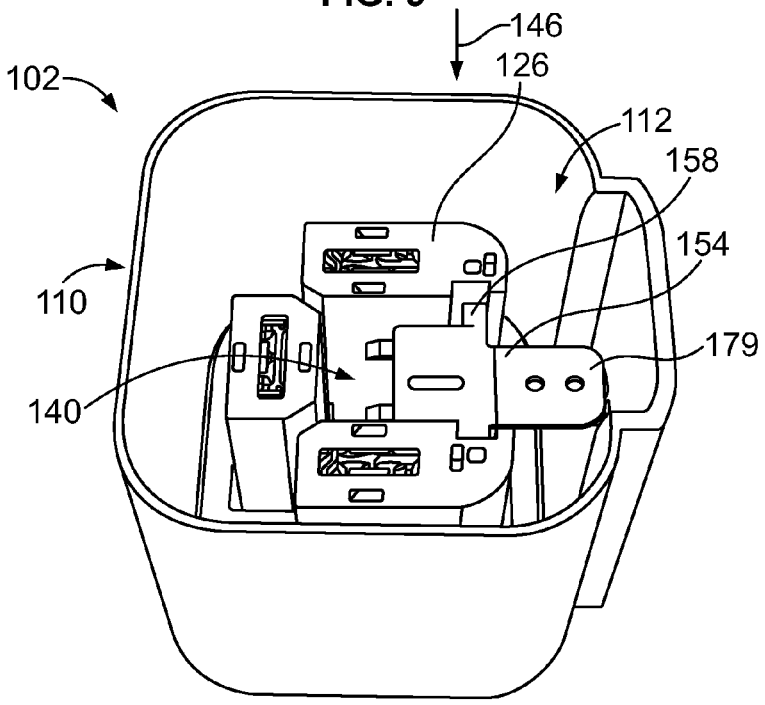
FIG. 10 is a perspective view of the electrical connector showing the locking device partially loaded into the housing.
Figure 11:
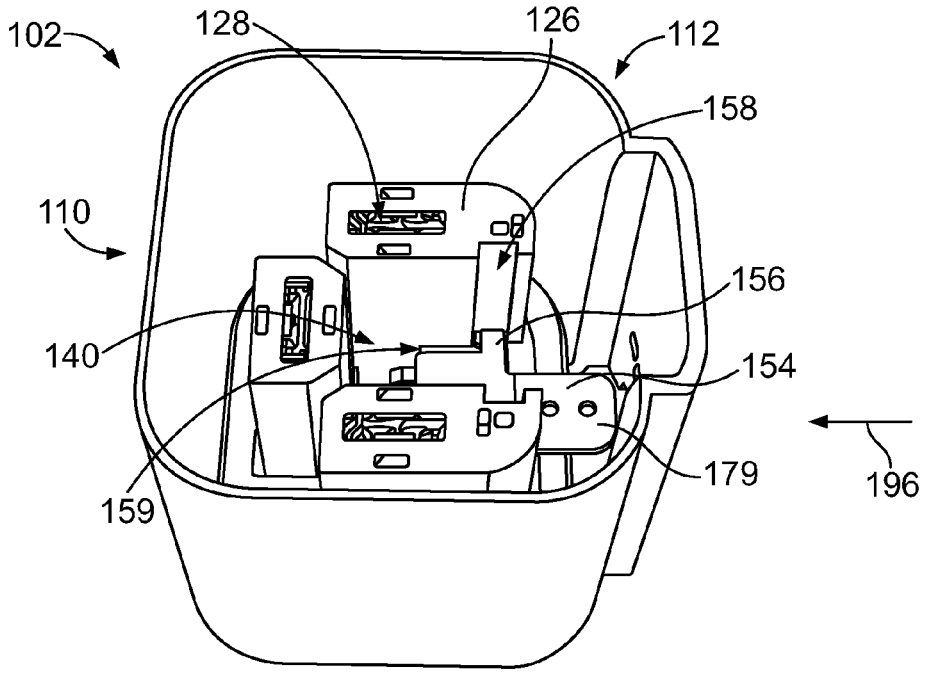
FIG. 11 is a perspective view of the electrical connector showing the locking device fully loaded into the housing to a loaded position.
Figure 12:
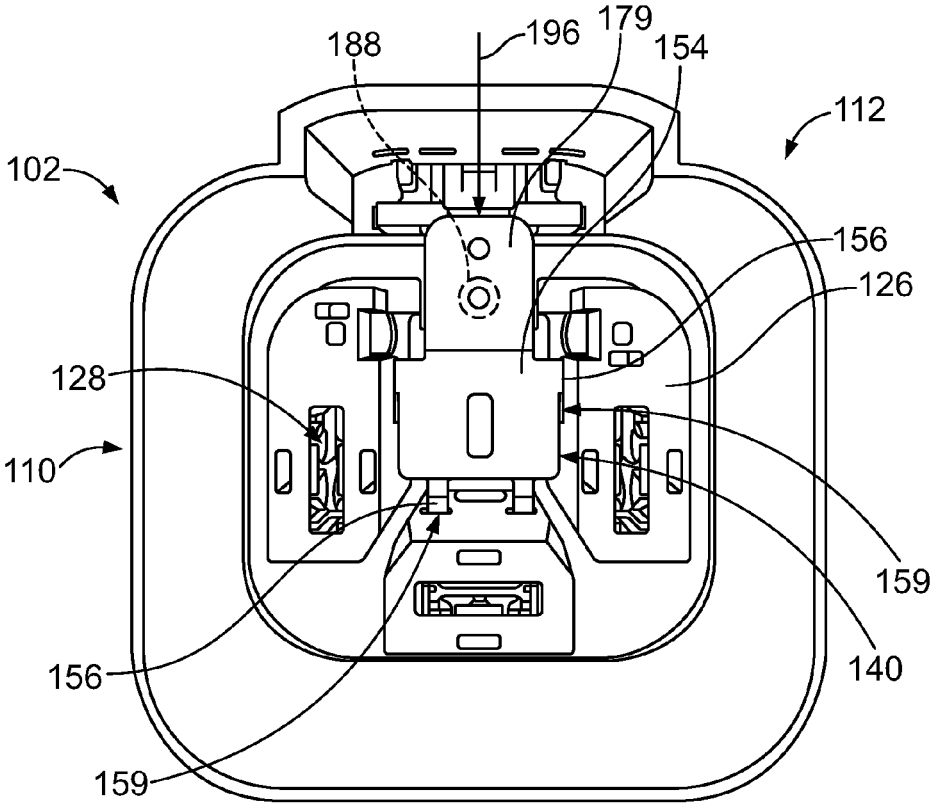
FIG. 12 is a top view of the electrical connector showing the locking device in an unlocked, pre-stage position in the housing.
Figure 13:
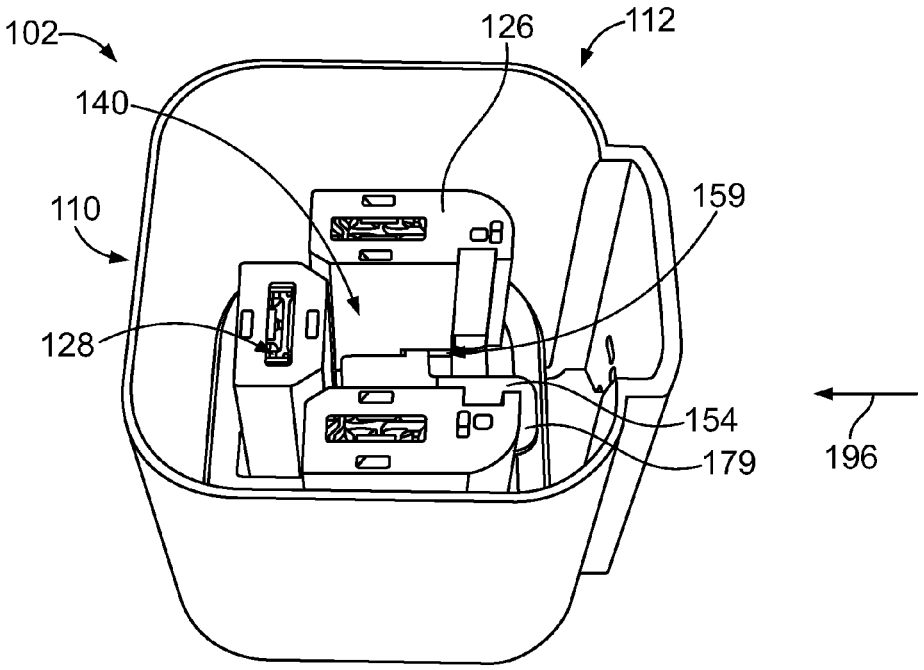
FIG. 13 is a perspective view of the electrical connector showing the locking device in a locked position in the housing.
Figure 14:
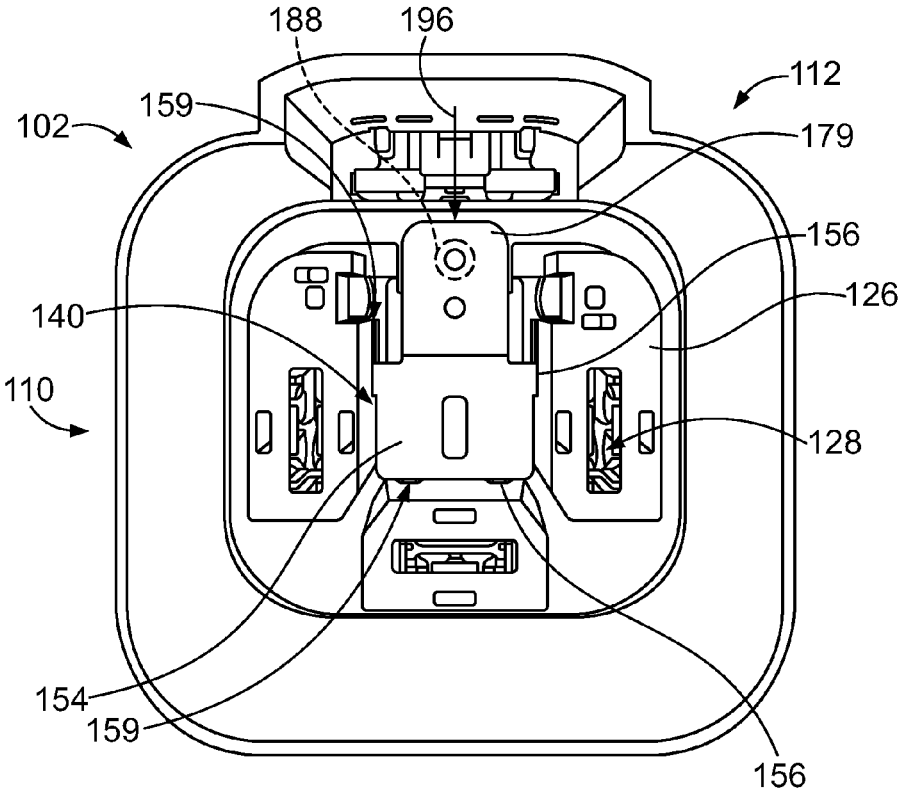
FIG. 14 is a top view of the electrical connector showing the locking device in a locked position in the housing.

FIGS. 9-14 illustrate an exemplary assembly of the electrical connector 102 showing loading the locking device 154 into the housing and then locking of the locking device 154. FIG. 9 shows the locking device 154 poised for loading into the housing 110. FIG. 10 shows the locking device partially loaded into the housing 110. FIG. 11 shows the locking device 154 fully loaded into the housing 110 to a loaded position. FIG. 12 shows the locking device 154 in an unlocked, pre-stage position in the housing 110. FIGS. 13 and 14 show the locking device 154 in a locked position in the housing 110.

During assembly, the insert 149 is loaded into the housing 110, such as through the mating end 118 at the front 114. The outer frame 150 and the perimeter seal 144 of the TPA device 112 are received in the perimeter cavity 142. When the TPA device 112 is loaded into the chamber 124, the shroud 122 surrounds the outer frame 150. The outer frame 150 is positioned between the shroud 122 and the exterior surface 132 of the terminal towers 126. The terminal towers 126 pass through the central opening 168 in the outer frame 150. The straps 170 pass through the gaps 136 between the terminal towers 126 such that the central plate 152 is positioned interior of or between the various terminal towers 126, such as in the central cavity 140.

After the insert 149 is loaded into the housing 110, the locking device 154 may be aligned (FIG. 9) with the central cavity 140 and loaded (FIG. 10) in the loading direction 146 into the central cavity 140. The locking device 154 is loaded through the mating end 118 at the front 114. The locking tabs 156 are aligned with the loading slots 158 and pass through the loading slots 158 as the locking device 154 is loaded into the central cavity 140. For example, the locking tabs 156 extending from the first and second sides 180, 182 are aligned with the loading slots 158 in the terminal towers 126 along the opposite first and second sides of the central cavity 140. In the illustrated embodiment, the terminal tower 126 on the third side of the central cavity 140 does not include loading slots 158 as the locking tabs 156 are spaced apart from such terminal tower 126 as the locking device 154 is loaded into the central cavity 140; however, in alternative embodiments, all of the terminal towers 126, including the terminal tower 126 in the third side, may have loading slots 158.

The locking device 154 is loaded into the central cavity 140 to the loaded position (FIG. 11). In the loaded position, the locking device 154 may be received in the mount 175 (shown in FIG. 5). The locking device 154 may bottom out against the central plate 152 (shown in FIG. 5) in the loaded position. In an exemplary embodiment, the locking tabs 156 are aligned with, but not received in, the locking slots 159 in the loaded position. The locking device 154 may be removable from the central cavity 140 from the loaded position, such as by lifting the locking device 154 out through the front 114. For example, the tail 178 may not be engaged with the guide channel 176 (both shown in FIG. 5) in the loaded position.

From the loaded position (FIG. 11), the locking device 154 may be slid in a locking direction 196. The locking device 154 may be moved to an unlocked position (FIG. 12). The locking tabs 156 are received in the locking slots 159 in the unlocked position; however the locking tabs 156 do not restrict loaded and unloading of the terminals 130 into the terminal channels 128. The locking tabs 156 do not block the terminals 130 in the unlocked position. As such the terminals 130 are not locked in the terminal channels 128 when the locking device 154 is in the unlocked position. The tail 178 engages the mount 175 in the unlocked position. The detent 188 is received in a first of the dimples on the securing plate 179 to secure the locking device 154 in the unlocked position.

The unlocked position may be a pre-stage position (FIG. 12). The housing 110 and the TPA device 112 may be shipped with the locking device 154 in the pre-stage position. In the pre-stage position, the locking device 154 will not freely fall out of the housing 110. In the pre-stage position, the locking device 154 is unlocked. Having the locking tabs 156 in the unblocking positions, allows for loading the terminals 130 into the housing 110 or unloading the terminals 130 from the housing 110. For example, in the pre-stage position, as the terminals 130 are loaded into the terminal channels 128, the terminals 130 slide past the locking tabs 156. After the terminals 130 clear the locking tabs 156, such as to fully loaded positions, the locking tabs 156 may be free to slide further to blocking positions to block the terminals 130 from removal from the terminal channels 128.

From the pre-staged or unlocked position, and after the terminals 130 are fully loaded into the housing 110, the locking device 154 may be moved to a locked position (FIGS. 13-14). The locking device 154 is slid in the locking direction 196. The terminals 130 must be clear of the locking tabs 156 to allow the locking device 154 to be moved to the locked position. For example, if one of the terminals 130 were only partially loaded and thus blocking the locking tab 156, the locking device 154 could not be moved to the locked position. The assembler would know that one of the terminals 130 was not fully loaded in such situation and would thus reassemble the terminals 130 to the fully loaded positions.

As the locking device 154 is slid in the locking direction 196, the locking tabs 156 are moved in, or into, the locking slots 159 of the terminal towers 126. In the locked position, the detent 188 is received in a second of the dimples on the securing plate 179 to secure the locking device 154 in the locked position. In the locked position, the locking tabs 156 are positioned immediately behind the terminals 130 in blocking positions to ensure the terminals 130 are unable to be removed from the terminal channels 128. Optionally, the single locking device 154 may block all of the terminals 130. Providing all of the locking tabs 156 at the central location (e.g., the central cavity 140) of the locking device 154 allows the use of a single locking device 154 to block all of the terminals 130. Having the locking tabs 156 extend in different directions, such as in perpendicular directions, allows tighter spacing of the terminals 130 and terminal towers 126 in the central location, which may reduce the overall size of the electrical connector 102 in one or more dimensions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mating end at a front of the housing and a base at a rear of the housing, the housing having a plurality of terminal towers extending forward of the base toward the mating end, each terminal tower having a terminal channel therein configured to receive a corresponding terminal therein, the terminal towers surrounding a central cavity between the plurality of terminal towers; and a terminal position assurance (TPA) device received in the central cavity, the TPA device being front loaded into the central cavity through the mating end in a loading direction toward the base, the TPA device including a locking device having a plurality of sides, the locking device having locking tabs extending from at least two of the sides, the locking device being loaded into the central cavity in the loading direction to a loaded position, the locking device being moved in a locking direction generally perpendicular to the loading direction from the loaded position to a locked position;

wherein the locking tabs allow movement of the terminals into and out of the terminal channels when in the loaded position; and wherein the locking tabs are at least partially received in the terminal channels in corresponding terminal towers in blocking positions for inhibiting removal of the terminals from the terminal channels when in the locked position.

2. The electrical connector of claim 1, wherein the terminal towers include locking slots open to the terminal channels, the locking tabs being received in the locking slots in the blocking positions when in the locked position.

3. The electrical connector of claim 1, wherein the locking device is slidable between the loaded position and the locked position.

4. The electrical connector of claim 1, wherein the terminal towers include loading slots extending along exterior surfaces of the terminal towers generally parallel to the loading direction and the terminal towers include locking slots extending along the exterior surfaces of the terminal towers generally parallel to the locking direction, the locking tabs being received in and passing through the loading slots as the locking device is moved in the loading direction to the loaded position, the locking tabs being received in and passing through the locking slots as the locking device is moved in the locking direction to the locked position.

5. The electrical connector of claim 1, wherein the locking device includes a main body defining the sides, the main body being positioned between each of the terminal towers such that the sides face corresponding terminal towers.

6. The electrical connector of claim 1, wherein the locking tabs extend from at least three different sides to interact with at least three different terminal towers.

7. The electrical connector of claim 1, wherein the TPA device includes a central plate received in the central cavity, the central plate including a mount, the locking device being slidably coupled to the mount to move between the loaded position and the locked position.

8. The electrical connector of claim 7, wherein the central plate includes a snap beam operably coupled to a corresponding terminal tower to secure the TPA device in the central cavity.

9. The electrical connector of claim 1, wherein the TPA device includes an outer frame receiving in the housing and surrounding an outer perimeter of the terminal towers, the TPA device including a central plate attached to the outer frame and being received in the central cavity, the locking device being coupled to the central plate.

10. The electrical connector of claim 9, wherein the outer frame includes a detent, the latching device includes a first dimple operably coupled to the detent in the latched position and the locking device including a second dimple operably coupled to the detent in the locked position.

11. The electrical connector of claim 9, wherein the housing includes a shroud extending forward from the base to the front, the shroud defining a chamber, the terminal towers being positioned in the chamber, the outer frame being received in the chamber between the terminal towers and the shroud.

12. The electrical connector of claim 9, wherein the locking device is loadable into the housing with the outer frame and the central plate to the loaded position, the locking device being movable relative to the central plate to the locked position.

13. The electrical connector of claim 1, wherein the locking device blocks mating of the electrical connector with a mating connector when the locking device is in the loaded position, the locking device providing clearance to allow mating of the electrical connector with the mating connector when the locking device is in the locked position.

14. An electrical connector comprising:

a housing having a mating end at a front of the housing and a base at a rear of the housing, the housing having a plurality of terminal towers extending forward of the base toward the mating end, each terminal tower having a terminal channel therein configured to receive a corresponding terminal therein, the terminal towers surrounding a central cavity between the plurality of terminal towers, the terminal towers having interior sides facing the central cavity, the internal sides having locking slots open to the terminal channels; and a terminal position assurance (TPA) device received in the central cavity, the TPA device being front loaded into the central cavity through the mating end in a loading direction toward the base, the TPA device including a locking device having a plurality of sides, the locking device having locking tabs extending from at least two of the sides, the locking device being loaded into the central cavity in the loading direction to a loaded position, the locking tabs being aligned with the locking slots in the loaded position, the locking device being moved in a locking direction generally perpendicular to the loading direction from the loaded position to a locked position, the locking tabs being positioned in the locking slots when in the locked position for blocking removal of the terminals from the terminal channels.

15. The electrical connector of claim 14, wherein the locking device is slidable between the loaded position and the locked position.

16. The electrical connector of claim 14, wherein the terminal towers include loading slots extending along exterior surfaces of the terminal towers generally parallel to the loading direction, the locking slots extending along the exterior surfaces of the terminal towers generally parallel to the locking direction, the locking tabs being received in and passing through the loading slots as the locking device is moved in the loading direction to the loaded position, the locking tabs being received in and passing through the locking slots as the locking device is moved in the locking direction to the locked position.

17. The electrical connector of claim 14, wherein the TPA device includes a central plate received in the central cavity, the central plate including a mount, the locking device being slidably coupled to the mount to move between the loaded position and the locked position.

18. The electrical connector of claim 14, wherein the TPA device includes an outer frame receiving in the housing and surrounding an outer perimeter of the terminal towers, the TPA device including a central plate attached to the outer frame and being received in the central cavity, the locking device being coupled to the central plate.

19. An electrical connector comprising:

a housing having a base at a rear of the housing and a shroud extending forward from the base to a mating end at a front of the housing, the shroud enclosing a chamber forward of the base, the housing having a plurality of terminal towers extending forward of the base into the chamber, each terminal tower having a terminal channel therein configured to receive a corresponding terminal therein, the terminal towers being spaced apart from each other and surrounded by gaps, the gaps defining a central cavity between the plurality of terminal towers, the gaps defining at least one perimeter cavity between the shroud and corresponding terminal towers; and a terminal position assurance (TPA) device received in the central cavity, the TPA device being front loaded into the central cavity through the mating end in a loading direction toward the base, the TPA device including an outer frame received in the at least one perimeter cavity between the shroud and the corresponding terminal towers, the TPA device including a central plate attached to the outer frame and positioned in the central cavity, the central plate having a mount extending therefrom, the TPA device including a locking device slidably coupled to the mount, the locking device having a plurality of sides, the locking device having locking tabs extending from at least two of the sides, the locking device being moved in a locking direction generally perpendicular to the loading direction to a locked position, wherein the locking tabs are at least partially received in the terminal channels in corresponding terminal towers in blocking positions for blocking removal of the terminals from the terminal channels when in the locked position.

20. The electrical connector of claim 19, wherein the terminal towers include loading slots extending along exterior surfaces of the terminal towers generally parallel to the loading direction and the terminal towers include locking slots extending along the exterior surfaces of the terminal towers generally parallel to the locking direction, the locking tabs being received in and passing through the loading slots as the locking device is moved in the loading direction to the loaded position, the locking tabs being received in and passing through the locking slots as the locking device is moved in the locking direction to the locked position.

* * * * *